US007441787B1

(12) United States Patent
Jordan

(10) Patent No.: US 7,441,787 B1
(45) Date of Patent: Oct. 28, 2008

(54) OFF ROAD SPORTS BOARD

(76) Inventor: Christopher Jordan, 1201 S. Douglas, Midwest City, OK (US) 73110

( * ) Notice: Subject to any disclaimer, the term of this patent is extended or adjusted under 35 U.S.C. 154(b) by 0 days.

(21) Appl. No.: 11/811,460

(22) Filed: Jun. 11, 2007

(51) Int. Cl.
*A63C 17/01* (2006.01)
*A63C 17/04* (2006.01)

(52) U.S. Cl. ..... 280/87.041; 280/842

(58) Field of Classification Search ..... 280/842, 280/87.01, 87.021, 87.041, 87.042
See application file for complete search history.

(56) References Cited

U.S. PATENT DOCUMENTS

| | | | | |
|---|---|---|---|---|
| 3,630,540 | A * | 12/1971 | Smith | 280/87.042 |
| 4,076,265 | A * | 2/1978 | Eash, II | 280/87.042 |
| 4,795,181 | A * | 1/1989 | Armstrong | 280/87.042 |
| 5,096,225 | A | 3/1992 | Osawa | |
| 5,152,691 | A | 10/1992 | Moscarello | |
| 5,169,166 | A | 12/1992 | Brooks | |
| 5,645,291 | A | 7/1997 | Ramage | |
| 6,059,303 | A | 5/2000 | Bradfield | |
| 6,270,096 | B1 | 8/2001 | Cook | |
| 6,343,803 | B1 * | 2/2002 | Johnston | 280/87.042 |
| 6,375,204 | B1 * | 4/2002 | Tu | 280/87.042 |
| 6,666,797 | B1 | 12/2003 | Martin | |
| 6,698,776 | B2 | 3/2004 | Todd | |
| D524,400 | S | 7/2006 | Langford | |
| D529,565 | S | 10/2006 | Warner et al. | |
| 2001/0048205 | A1 * | 12/2001 | Schouten et al. | 280/11.27 |
| 2002/0011728 | A1 * | 1/2002 | Osawa | 280/842 |
| 2002/0089137 | A1 * | 7/2002 | Chang et al. | 280/87.041 |
| 2003/0107199 | A1 * | 6/2003 | DeSchinkel | 280/87.042 |

* cited by examiner

*Primary Examiner*—Frank B Vanaman
(74) *Attorney, Agent, or Firm*—Randal D. Homburg

(57) ABSTRACT

An off road sports board provides a rider with the experience of snowboarding on dirt, gravel or other particulate materials when and where snow is not present, the sports board having an overall elongated oval configured deck having an upper surface having front and rear bindings within which the rider stands and a lower surface attaching a lower mounting plate from which extends a front fixed wheel assembly having a first lateral contoured wheel, an adjustable middle wheel assembly having a second lateral contoured wheel and a rear fixed wheel assembly having a third lateral contoured wheel, the first and third lateral contoured wheels having a smaller central diameter than a central diameter of the second lateral contoured wheel, wherein either the second and third lateral contoured wheel may be in contact with level ground at the same time, or the first and second lateral contoured wheels are in contact with level ground at the same time.

6 Claims, 3 Drawing Sheets

OFF ROAD SPORTS BOARD

CROSS REFERENCE TO RELATED APPLICATIONS

U.S. Utility patent application Ser. No. 11/713,946 filed Mar. 5, 2007 and U.S. Design patent application Ser. No. 29/273,406 filed Mar. 5, 2007, by the same inventor, Christopher Jordan.

I. BACKGROUND OF THE INVENTION

1. Field of Invention

An off road sports board provides a rider with the experience of snowboarding on dirt, gravel or other particulate materials when and where snow is not present, the sports board having an overall elongated oval configured deck having an upper surface having front and rear bindings within which the rider stands and a lower surface attaching a lower mounting plate from which extends a front fixed wheel assembly having a first lateral contoured wheel, an adjustable middle wheel assembly having a second lateral contoured wheel and a rear fixed wheel assembly having a third lateral contoured wheel, the first and third lateral contoured wheels having a smaller central diameter than a central diameter of the second lateral contoured wheel, wherein either the second and third lateral contoured wheel may be in contact with level ground at the same time, or the first and second lateral contoured wheels are in contact with level ground at the same time.

2. Description of Prior Art

The following United States patents were discovered and are disclosed within this application for utility patent. All relate to sports boards, with and without wheels.

In U.S. Pat. No. 6,270,096 to Cook and U.S. Pat. No. 6,059,303 to Bradfield, a portion of the wheels on the underside of a skateboard are presented in an in-line configuration, with Cook having two sets of three wheels with a steerable means on the truck. A snowboard is disclosed in U.S. Design Pat. No. D524,400 to Langford, disclosing a plurality of lower fins which allow for steering of the board by the angle of the upper deck.

Two disclosed skateboards, indicated in U.S. Pat. No. 5,645,291 to Ramage and U.S. Pat. No. 5,169,166 to Brooks, disclose skateboards having oversized wheels for use on off-road terrains, with Brooks offering a tilt steering means which directs the wheels at angles congruent with the tilt of the upper deck. U.S. Pat. No. 5,096,225 to Osawa discloses a skateboard having plurality of reduced diameter rollers on the underside for use of the skateboard on grass, the upper deck being flexible to conform to the varying terrain to allow all the wheels to remain in contact with the grass turf.

A wheeled board apparatus for attachment to a rider's feet, the lower deck having wheels which include two wheels in line located in the center, and two sets of outer wheels along two outer contoured edges. In another U.S. Pat. No. D529,565 to Warner, a skateboard with an arch shaped platform includes three sets of tandem wheels, one set on each end with a set in the middle.

A snowboard balance simulator is disclosed in U.S. Pat. No. 5,152,691 to Moscarello which has a single central roller base having a football shaped contour, but has no direct attachment to the upper board member. It is not intended for travel, nor is the training device disclosed in U.S. Pat. No. 6,666,797 to Martin. U.S. Pat. No. 6,698,776 to Todd, discloses a skateboard with a snowboard response having contoured wheels, with two large diameter front and rear wheels affixed to the bottom of the board and two smaller diameter wheel located in front and behind the respective larger diameter wheels, demonstrating a tilting application indicated in FIG. 5, but requiring release of all pressure from the elevated end to accomplish the tilting movement.

The present invention discloses a different association of its members, having the second lateral contoured wheel adjustable along parallel longitudinal support tracks with a means to adjust and secure the location of the second lateral contoured wheel at a chosen location along the length of the deck.

II. SUMMARY OF THE INVENTION

Snowboarding has become an increasingly popular winter sport. Most of the country, however, does not have the capability of providing the appropriate environment for this activity to occur, either due to a lack of snow in that geographic region, or snow being unavailable during most of the warmer months of the year. Artificial snow has been provided to engage in this activity which costs a great deal of money to maintain and only limited use can be had because of space restrictions.

Oversized skateboards have also been provided which simulate snowboarding, but they are limited in their use to appropriate surfaces, either the streets, or a very fine dirt or sand. Theses boards usually have large diameter oversized wheels or provide the board with numerous lower wheels or a flexible upper deck.

The present board is intended to most closely simulate snowboarding by providing an oversized skateboard with an overall elongated oval configured deck having an upper surface to which front and rear bindings are attached and within which the rider stands and a lower surface attaching a lower mounting plate from which extends a front fixed wheel assembly having a first lateral contoured wheel, an adjustable middle wheel assembly having a second lateral contoured wheel, and a rear fixed wheel assembly having a third lateral contoured wheel, the adjustable middle wheel assembly slidably engaging two parallel longitudinal support tracks within the lower mounting plate between the front and rear wheel assemblies, the adjustable middle wheel assembly secured within the longitudinal support tracks by a securing means, the first and third lateral contoured wheels having a smaller central diameter than a central diameter of the second lateral contoured wheel, wherein either the second and third lateral contoured wheel may be in contact with level ground at the same time, or the first and second lateral contoured wheels are in contact with level ground at the same time, wherein travel over coarse off-road surfaces may be gained.

The primary objective of the off-road sports board is to provide a board simulating the sport of snowboarding on a surface not covered in snow. A second objective is to provided the board with the lateral contoured wheels having the first and third lateral contoured wheels smaller in diameter than the second lateral contoured wheel, the second wheel also extending lower than either the first or third wheels, allowing for tilting and a quick and smooth rotation of the direction of travel of the board while the rider's feet are set within bindings on the upper surface of the deck for quick turns and maneuvering. A third objective is to provided the each lateral contoured wheel to travel upon rough and uneven surfaces found on hills and trails as well as pipes, streets and places suitable for a skateboard.

III. DESCRIPTION OF THE DRAWINGS

The following drawings are submitted with this utility patent application.

IV. DESCRIPTION OF THE PREFERRED EMBODIMENT

Figure 1:
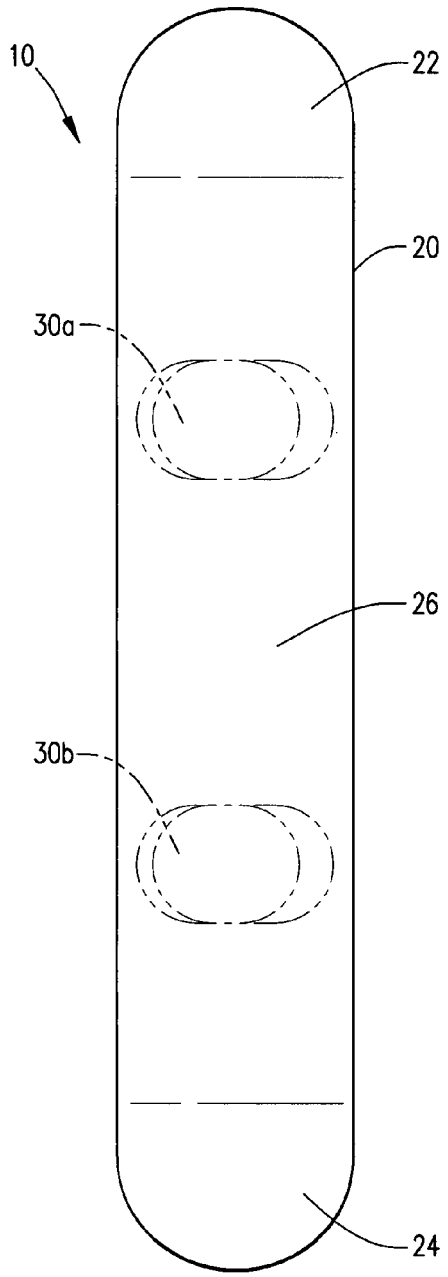
FIG. 1 is a top plan view of the off road sports board.

A sports board 10 simulating the sport of snowboarding on surfaces not covered in snow, shown in FIGS. 1-7 of the drawings, the sports board 10 comprising an elongated oval configured deck 20 having a front end 22, a rear end 24, an upper surface 26 upon which are mounted a front binding 30*a* and rear binding 30*b* attaching to the feet of a rider, and a lower surface 28 attaching an upper surface 42 of a lower mounting plate 40, the lower mounting plate 40 further having a lower surface 44 from which extends a front fixed wheel assembly 60 having a first lateral contoured wheel 61, an adjustable middle wheel assembly 90 having a second lateral contoured wheel 91, and a rear fixed wheel assembly 70 having a third lateral contoured wheel 71, the adjustable middle wheel assembly 90 slidably engaging two parallel longitudinal slots 46 within the lower surface 44 of the lower mounting plate 40 between the front and rear wheel assemblies 60, 70, the adjustable middle wheel assembly 90 secured within the longitudinal slots 46 by a securing means 50, the first and third lateral contoured wheels 61, 71, having a respective smaller central diameter 63, 73, than a central diameter 93 of the second lateral contoured wheel 91, wherein either the second and third lateral contoured wheels 91, 71, may be in contact with level ground at the same time, or the first and second lateral contoured wheels 61, 91, are in contact with level ground at the same time, wherein travel over coarse off-road surfaces may be gained The front and rear wheel assemblies 60, 70, are further defined as having a pair of descending lower bracket members 66, 76, extending from the lower mounting plate 40, each pair of descending lower bracket members 66, 76, having an axially aligned axle aperture 67, 77, within which is secured an axle 68, 78, upon which each respective first and third lateral contoured wheel 61, 71, is rotatably mounted. For ease of rotation, each first and third lateral contoured wheel 61, 71, includes a central bore, not shown, including at least one bearing, also not shown. It is preferred that the front and rear fixed wheel assemblies 61, 71, be placed at a location $\alpha$ indicated in FIG. 3, the front fixed wheel assembly 61 approximately 20% of the overall length $\Delta$ of the sports board 10 measured from the front end 22 of the sports board and the rear fixed wheel assembly 71 placed at a location $\beta$ approximately 80% of the overall length $\Delta$ of the sports board measured from the front end 22 of the sports board 10.

Figure 2:
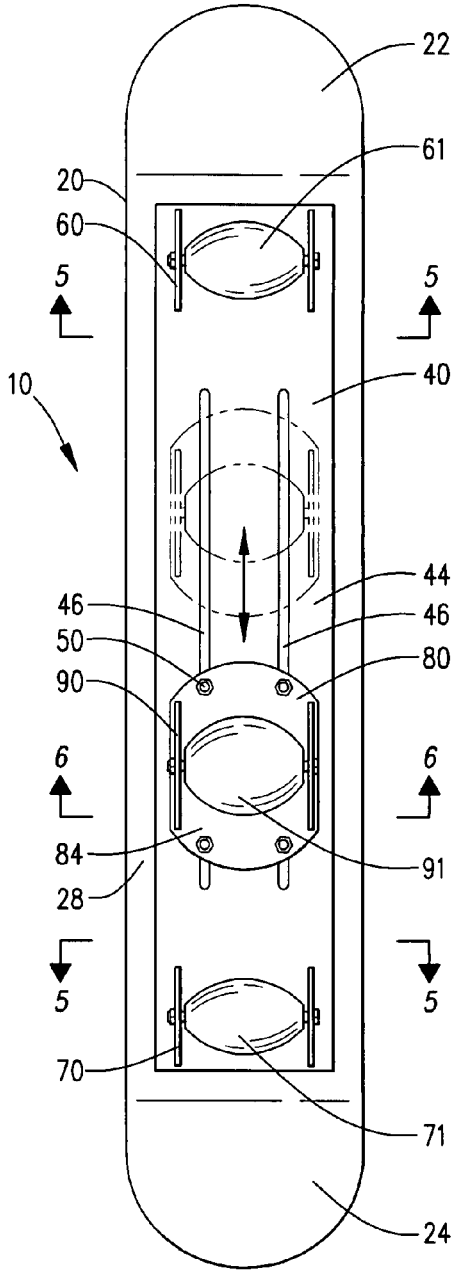
FIG. 2 is a lower view of the sports board.
Figure 6:
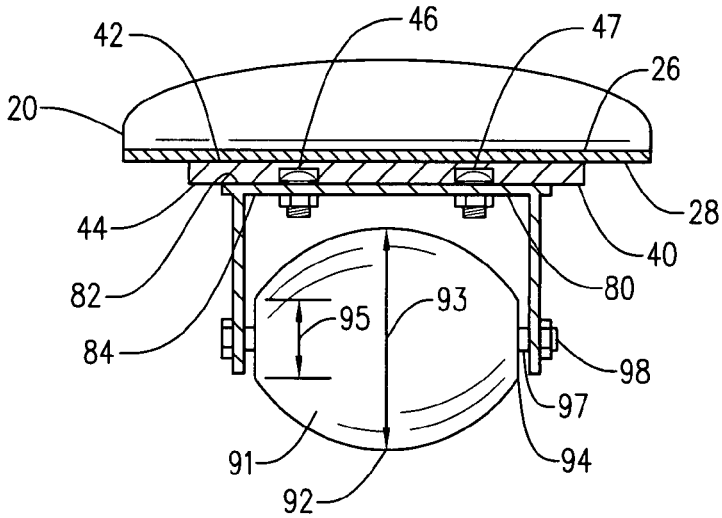
FIG. 6 is a cross sectional view of the board along section lines 6/6 of FIG. 2.
Figure 7:
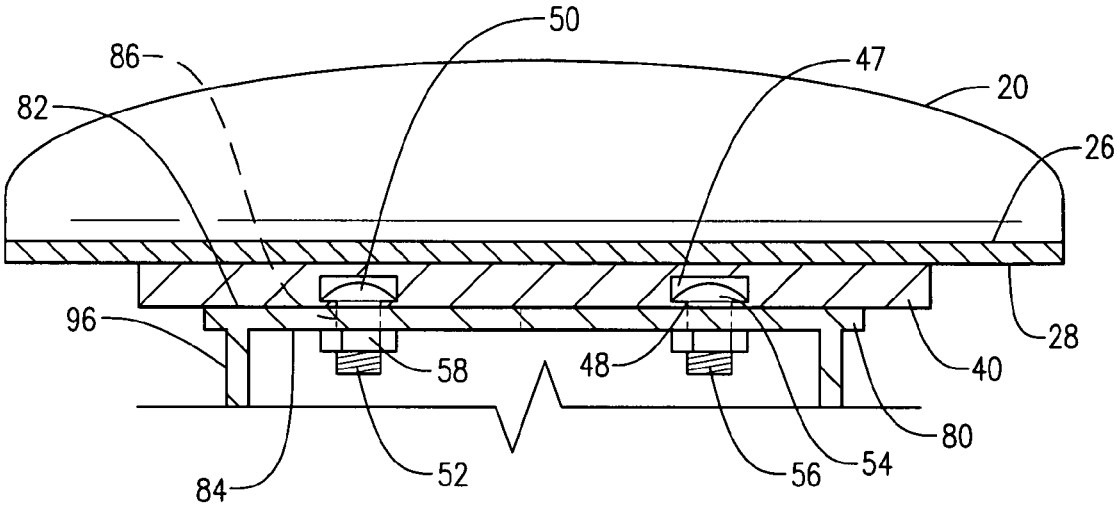
FIG. 7 is a close-up cross-sectional view of a portion of FIG. 6 indicating the securing means attaching the second adjustable wheel assembly within the parallel longitudinal support tracks.

The adjustable middle wheel assembly 90, shown in FIGS. 2, 6 and 7, further defines an upper slide plate 80 having an upper surface 82 placed against the lower mounting plate 40 and a lower surface 84 from which extends a pair of descending lower bracket members 96 having an axially aligned axle aperture 97 within which is secured an axle 98 upon which the second lateral contoured wheel 91 is rotatably mounted. For ease of rotation, the second lateral contoured wheel 91 may include a central bore, not shown, including at least one bearing, also not shown.

Each parallel longitudinal slot 46 in the lower surface 44 of the lower mounting plate 40, shown in FIG. 7, further defines an inner channel 47 and a narrowed channel opening 48. The securing means 50, as shown in FIGS. 2, 3, 6 and 7, comprises at least four bolts 52 having a flared head portion 54 retained within the inner channel 47 of the each longitudinal slot 46 and a threaded shaft portion 56 extending from the head portion 54 through the narrowed channel opening 48 and through at least four bolt holes 86 through the upper slide plate 80 of the adjustable middle wheel assembly 90, and a locking nut 58 threaded upon the threaded shaft portion 56 of each of the at least four bolts 52 tightened against the upper slide plate 80 locking the middle wheel assembly 90 in a selected position. Preferable shown in FIG. 3, the adjustable middle wheel assembly 90 may be positioned at a location $\theta$ between approximately 40% to 60% of the overall length $\Delta$ of the sports board 10 measured from the front end 22 of the sports board 10, further shown in FIG. 2.

Each first, second and third lateral contoured wheel 61, 71, 91, is further defined as having respective outer portions 64, 74, 94, having respective outer diameters 65, 75, 95, and respective central portions 62, 72, 92, having respective central diameters 63, 73, 93, larger than the respective outer diameters 65, 75, 95. The overall appearance of each first, second and third lateral contoured wheel 61, 71, 91, is similar to that of a football. Each wheel is made of a material which would be durable and subjected to impact without deformation or destruction under the amount of force each contoured wheel would endure while in use, including the weight of a rider, the impact forces from jumping off ramps or elevations, and use on hard developed surfaces and natural composition surfaces. The materials for the contoured wheels may include plastic polymers, epoxy materials, plastic resins, rubber or carbon plastics.

Figure 3:
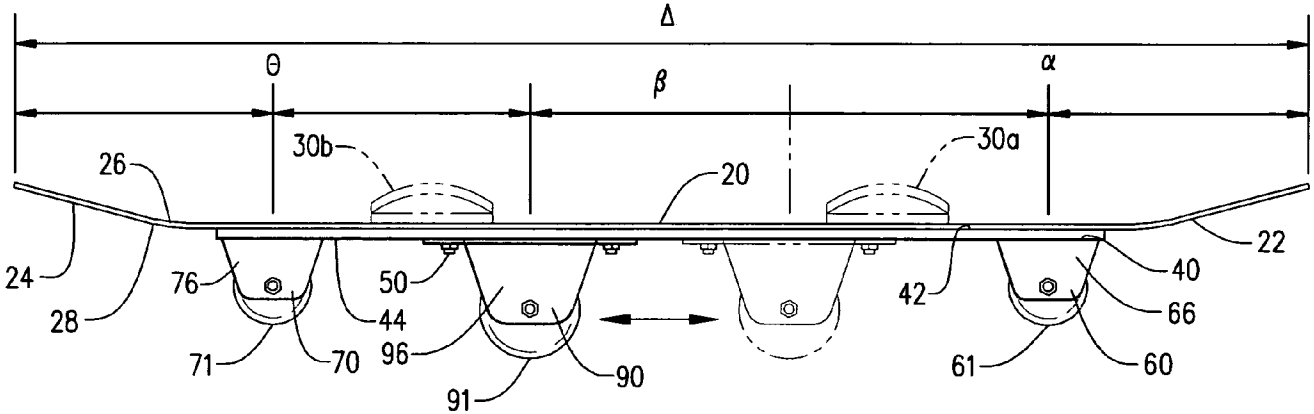
FIG. 3 is a side profile view of the board.
Figure 5:
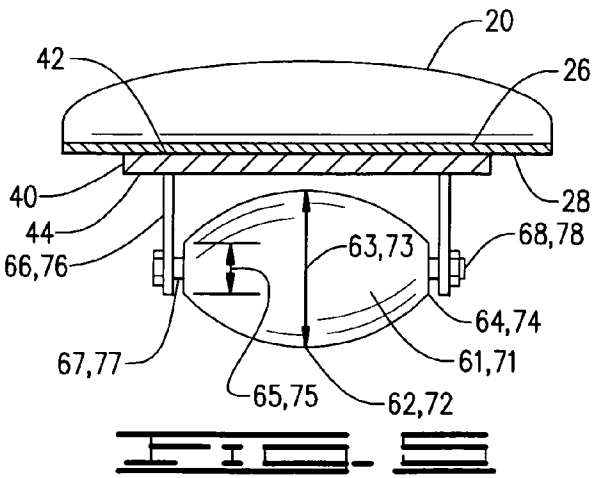
FIG. 5 is a cross-sectional view of the board along section lines 5/5 of FIG. 2.
Figure 4:
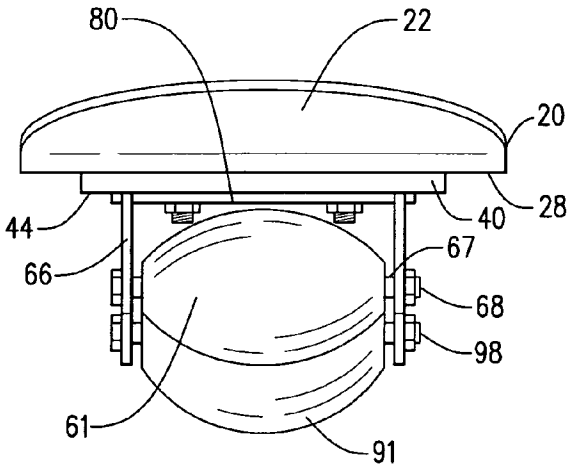
FIG. 4 is a front end view of the board.

The central diameter 93 of the second lateral contoured wheel 91 being larger than the central diameter 63, 73, of the first and third lateral contoured wheels 61, 71, along with the extension of the second lateral contoured wheel 91 lower than the extension of the first and third lateral contoured wheels 61, 71, FIG. 3, allows the rider to rock the sports board 10 to the front or rear ends 22, 24 of the sports board 10 while on a surface with pivoting over the second contoured wheel 91, using the weight of the user applied to the front or rear feet of the user in the bindings to execute such pivot. This allows a user to elevate or lower the respective front and rear ends 22, 24 of the sports board 10 during use to steer the board, to reverse direction, to bounce the sports board 10 and to create a spring in the deck 20 of the sports board 10 to compel the sports board to go airborne during use using weight distribution and the actions of the user to control the direction, speed and maneuvering of the board down a hill, on a level surface, on an obstacle coarse or a competitive course not having a surface covered in snow, yet simulating the actions of a person on a snowboard.

While the invention has been particularly shown and described with reference to a preferred embodiment thereof, it will be understood by those skilled in the art that changes in form and detail may be made therein without departing from the spirit and scope of the invention.

I claim:

1. A sports board simulating the sport of snowboarding on surfaces not covered in snow, said sports board comprising:

an elongated oval configured deck having a front end, a rear end, an upper surface upon which are mounted a front and rear binding attaching to the feet of a rider, and a lower surface;

a lower mounting plate having an upper surface attached to said lower surface of said deck, said lower mounting plate having a lower surface;

a front fixed wheel assembly having a first lateral contoured wheel extending from said lower surface of said lower mounting plate;

a rear fixed wheel assembly having a third lateral contoured wheel extending from said lower surface of said lower mounting plate; and an adjustable middle wheel assembly having a second lateral contoured wheel, said adjustable middle wheel assembly slidably engaging two parallel longitudinal slots within said lower surface of said lower mounting plate between said front and rear wheel assemblies, said adjustable middle wheel assembly secured within said longitudinal slots by a securing means, wherein said first and third lateral contoured wheels have a central diameter smaller than a central diameter of said second lateral contoured wheel and said second lateral contoured wheel extends further from said lower mounting plate than said first and third lateral contoured wheels.

2. The sports board, as disclosed in claim 1, wherein:

said front and rear wheel assemblies define a pair of descending lower bracket members extending from said lower mounting plate, each pair of descending lower bracket members having an axially aligned axle aperture within which is secured an axle upon which each respective first and third lateral contoured wheel is rotatably mounted; and said adjustable middle wheel assembly defines an upper slide plate having an upper surface placed against said lower mounting plate and a lower surface from which extends a pair of descending lower bracket members having an axially aligned axle aperture within which is secured an axle upon which said second lateral contoured wheel is rotatably mounted.

3. The sports board, as disclosed in claim 1, further comprising:

each said parallel longitudinal slot in said lower surface of said lower mounting plate defines an inner channel and a narrowed channel opening; and said securing means includes at least four bolts having a flared head portion retained within said inner channel of said each longitudinal slot and a threaded shaft portion extending from said head portion through said narrowed channel opening and through at least four bolt holes through an upper slide plate of said adjustable middle wheel assembly, and a locking nut threaded upon said threaded shaft portion of each of said at least four bolts tightened against said upper slide plate locking said middle wheel assembly in a selected position.

4. The sports board, as disclosed in claim 1, each said first, second and third lateral contoured wheel further defining respective outer portions having a common outer diameter and a respective central portion having said respective central diameters larger than said respective outer diameters, each lateral contoured wheel is made of a material which is durable when subjected to impact without deformation or destruction under the amount of force each said lateral contoured wheel would endure while in use resulting from the weight of a rider, the impact forces from jumping off ramps or elevations, and use on hard improved surfaces and natural composition surfaces.

5. The sports board, as disclosed in claim 1, wherein:

said deck defines an overall length;

said front and rear wheel assemblies define a pair of descending lower bracket members extending from said lower mounting plate, each pair of descending lower bracket members having an axially aligned axle aperture within which is secured an axle upon which each respective first and third lateral contoured wheel is rotatably mounted;

said adjustable middle wheel assembly defines an upper slide plate having an upper surface placed against said lower mounting plate and a lower surface from which extends a pair of descending lower bracket members having an axially aligned axle aperture within which is secured an axle upon which said second lateral contoured wheel is rotatably mounted; and said front wheel assembly is fixed at a position 20% of said overall length from said front end of said deck, said rear wheel assembly is fixed at a position 80% of said overall length from said front end of said deck, and said adjustable middle wheel assembly is adjustable in a position between 40% and 60% of said overall length from said front end of said deck.

6. The sports board, as disclosed in claim 1, wherein:

said deck defines an overall length;

said front and rear wheel assemblies define a pair of descending lower bracket members extending from said lower mounting plate, each pair of descending lower bracket members having an axially aligned axle aperture within which is secured an axle upon which each respective first and third lateral contoured wheel is rotatably mounted;

said adjustable middle wheel assembly defines an upper slide plate having an upper surface placed against said lower mounting plate and a lower surface from which extends a pair of descending lower bracket members having an axially aligned axle aperture within which is secured an axle upon which said second lateral contoured wheel is rotatably mounted;

said front wheel assembly is fixed at a position 20% of said overall length from said front end of said deck, said rear wheel assembly is fixed at a position 80% of said overall length from said front end of said deck, and said adjustable middle wheel assembly is adjustable in a position between 40% and 60% of said overall length from said front end of said deck;

each said parallel longitudinal slot in said lower surface of said lower mounting plate defines an inner channel and a narrowed channel opening; and said securing means comprising at least four bolts having a flared head portion retained within said inner channel of said each longitudinal slot and a threaded shaft portion extending from said head portion through said narrowed channel opening and through at least four bolt holes through said upper slide plate of said adjustable middle wheel assembly, and a locking nut threaded upon said threaded shaft portion of each of said at least four bolts tightened against said upper slide plate locking said middle wheel assembly in a selected position.

* * * * *